United States Patent [19]

Hansen

[11] 3,962,878

[45] June 15, 1976

[54] STABILIZATION OF MARITIME STRUCTURES

[75] Inventor: Frode Johan Hansen, Kingswood, England

[73] Assignee: Redpath Dorman Long (North Sea) Limited, Bedford, England

[22] Filed: July 17, 1974

[21] Appl. No.: 489,392

[30] Foreign Application Priority Data

July 20, 1973 United Kingdom ..... 34680/73
Oct. 9, 1973 United Kingdom ..... 47095/73

[52] U.S. Cl. ..... 61/46.5; 61/46
[51] Int. Cl.[2] ..... E02B 17/00
[58] Field of Search ..... 61/46.5, 47; 114/.5, 114/26, 31, 50; 175/7, 8

[56] References Cited

UNITED STATES PATENTS

| | | | |
|---|---|---|---|
| 483,697 | 10/1892 | Rich | 61/64 |
| 2,661,600 | 12/1953 | Hopkins | 61/46.5 |
| 2,895,301 | 7/1959 | Casagrande et al. | 61/46.5 |
| 3,013,396 | 12/1961 | Suderow | 61/46.5 |
| 3,165,898 | 1/1965 | Elliott | 114/.5 D X |
| 3,412,563 | 11/1968 | Sharp | 61/46.5 |
| 3,803,855 | 4/1974 | Malkiel | 61/46.5 |

FOREIGN PATENTS OR APPLICATIONS

| | | | |
|---|---|---|---|
| 1,088,804 | 10/1967 | United Kingdom | 61/46.5 |

*Primary Examiner*—Dennis L. Taylor
*Attorney, Agent, or Firm*—Bacon & Thomas

[57] ABSTRACT

A maritime assembly incorporating a foundation raft for founding, or when founded, on a sea bed, and having venting means responsive to the movement of waves whereby pore pressure at at least one point beneath the raft is reduced with respect to the hydrostatic pressure appropriate to the external depth of water below the mean level of water in which the raft is (to be) founded.

11 Claims, 3 Drawing Figures

STABILIZATION OF MARITIME STRUCTURES

The problems associated with the design, construction and installation of piled off-shore structures increase in magnitude with water depth and wave height so rapidly that at some stage these problems may become too difficult or too costly to solve practically.

The problems associated with non-piled ("gravity") off-shore structures also increase with water depth and wave height but by no means so rapidly. The main problems appear to be of a soil mechanical nature caused by the dynamic effects of the wave action, and the question is simply whether it is cheaper and more practical to solve these problems than those created by the pile driving process.

The present invention tries to produce a practical gravity structure by utilising the wave action to generate added stability against the unavoidable overturning forces.

The waves produce inertia and drag forces on all members of the structure as they pass through the structure and these forces are of great importance for the design of individual structure members. The horizontal component of these forces is the governing factor with regard to overturning of the structure. The vertical component also makes a contribution, but this is completely over-shadowed by the hydrostatic pressure upon the foundation raft itself.

In addition to the drag and inertia forces the waves also cause variations in the hydrostatic pressures corresponding to the variations in water depth between the troughs and crests of successive waves, and these varying pressures at seabed level cause variations in the pore water pressures in the seabed material, so that pressure gradients are created and water movements may take place. This situation is further complicated by the introduction of a gravity structure in or on the seabed, which suddenly makes a part of the seabed impervious. Little is known about the pore pressure variations underneath a rigid impervious raft when a wave passes over the top of the raft but there can be no doubt that variations will take place and that the amplitude of these variations will depend on the ground conditions and will diminish with depth below seabed level.

The importance of the pore water pressure is best illustrated by an example. If we assume that the 30 m design wave produces a pressure variation at seabed level of $\pm$ 15 T/m$^2$ then the pressure variations underneath the raft do not have to be very much smaller or very much out of phase to produce pressure differentials of $\pm$ 10 T/m$^2$. If the pore pressure is less than the corresponding external hydrostatic pressure it is equivalent to an increase in ground pressure of 10 T/m$^2$. If on the other hand the pressure underneath the raft happens to be 10 T/m$^2$ higher than the corresponding external hydrostatic pressure the ground pressure is reduced by that amount.

The sudden increase in ground pressure of 10 T/m$^2$ is not the main problem; it is the reduction of effective ground pressure which is serious. The structure may become a "hovercraft" on a water cushion and lose much of its sliding resistance.

A conventional gravity structure on top of the seabed can only counteract this loss of sliding resistance by adding extra weight, but a raft sunk into the seabed or cut off from the external pressure by means of a skirt does not require such extra weight. Sliding is prevented by the passive pressures from the surrounding ground.

It is not just the sliding resistance between structure and soil which is in danger when the pore water pressure exceeds the external hydrostatic pressure; it is also the internal friction in the ground itself and in consequence its carrying capacity. It is a well known fact that liquifaction of the ground can take place in certain circumstances. The worst combination is a high upward pressure gradient and minimum overburden pressure and such a combination is most likely to occur at the "tension" side of the foundation raft when the structure is subject to a maximum over-turning effect by the waves. In such zones where liquification can take place structures are prone to settlements. After some wave tests it was found that a model gravity structure had tilted towards the waves. The pumping action of the base had apparently liquified the material at the edge of the structure and gradually pumped the loosened material away from underneath the base.

A gravity structure resting on the seabed is extremely dependent upon the soil mechanical properties of the seabed. It is difficult to carry out soil investigations of the required nature in water depths of 150 m and it is also difficult to ensure that the structure is in fact resting upon the area investigated. It must therefore be necessary to make conservative assumptions when designing a structure to rest upon an unprepared seabed.

The problem of variations in pore water pressure due to wave action with the accompanying risk of liquifaction of the ground, will be reduced by digging the raft into the seabed and adding the stabilising effect of surrounding over-burden pressure. The risk can be further reduced by a simple additional control of the pore water pressure underneath the raft.

To this end a shaft communicates freely with the underside of the foundation raft. The water level inside this shaft is controlled by the external water level in so far as a one way valve permits the water in the shaft to escape when the external water level is lower than that inside the shaft. For still water there will be no difference between the two water levels, but in wave action there will be a tendency for the inner water level to be lower than the outer water level, provided that the valve system will let water out quicker than the seabed soil will let water in. Based upon the results of full scale pumping tests carried out after the foundation raft has been dug in it is a simple matter to design the shaft and the one-way valve in such a way that the internal water level will approach the external trough level during wave action. With such an arrangement it is possible to maintain the pore water pressure underneath the raft at such a low level that there is no danger of liquifaction at any time.

The design of the shaft and the valve system is of course dependent upon the permeability of the seabed, the foundation depth into the seabed and the degree of pore water pressure control which has to be achieved. If the seabed is relatively impermeable, there will be no problem, as differential pressure will not be transmitted to the underside of the raft. If the seabed is completely permeable, as might be the case with loosly packed coarse gravel, then no pressure build up could occur. It is in an intermediate range of permeabilities that the present invention is applicable, and so the actual seepage rate is of considerable importance.

It is impossible to predict the rate of seepage very accurately even with good soil information. After founding the raft it is possible to install pumping capacity in excess of any reasonable seepage rate and it is a simple matter to carry out some pumping tests and establish the actual permeability of the ground. Should by any chance the permeability of the ground exceed the pumping capacity it can probably be said that there isn't any real foundation problem. The ground is most likely of such a nature that there is no risk of settlements or difficulties with bearing pressures, and any danger of scour or sliding can of course be eliminated by digging in deep enough.

If we now assume that the pumping tests have shown that the seepage rate = $1^{m3}$/sec for a pressure drop of 10m, the problem is to design and install a system of one-way valves in the central shaft to keep the water level in the shaft at a specified height below the external level.

It is not necessary in this specification to make an accurate calculation and some simplifying assumptions can be made. Taking the design wave of 30m height and a period of 16 seconds, let's assume that the external level is above the internal level for 14 seconds and the average difference in water levels is 15m. The seepage into the shaft would then be $$Q = 1.5 \times 14 = 21\text{m}^3 \text{ in 14 seconds.}$$

The area of the central shaft is, say $7\text{m}^2$ and the water level would therefore rise by 3.0m.

Assuming that the average water level difference is 1.5m during the period when water drains out of the shaft the water velocity up the shaft will be $$v = \sqrt{2gh} = \sqrt{30} = 5.5 \text{ m/sec}$$

Calling the valve area A and assuming that the capacity of the valve during the 2 seconds it is open is $2 \times A \times 5.5 = 21\text{m}^3$ the valve area $A = 2.0\text{m}^2$ Taking into account that the valves can be installed anywhere below lowest wave trough level it is obviously not difficult to achieve the required capacity, and it is furthermore possible to postpone this decision until after the pumping tests without delaying the overall construction period.

In less permeable ground than clean sand the valves will be quite modest but they would add immensly to the safety of the foundation. If the average reduction in pressure amounts to 10m during the design wave period it is effectively equivalent to an increased weight of 80.000 tons of structure. There is no reason why the valves shouldn't be reliable. Their design can be based upon a full scale pumping test, their proper functioning can readily be checked and they can be inspected adjusted repaired or replaced at any time.

They also offer the further advantage that the additional effective weight only acts during wave action. In calm weather the structure will be much lighter than other gravity structures and that could be of great importance in soft grounds where settlements could become excessive.

The invention provides a free standing maritime platform assembly incorporating a foundation raft for founding in water on a sea bed, said raft having underneath it an impermeable base surface, and remote from the edge of that surface an opening, a duct connected between that opening and a reservoir means associated with said platform assembly and venting means connected to and communicating with the reservoir, said venting means including one way valve means responsive to the movement of waves and capable of permitting the egress of water from the reservoir if the trough of a wave passes over the raft, which one way valve is located at an elevation above said raft and below the lowest mean water level envisaged, whereby pore water pressure at at least one point beneath the raft may be reduced with respect to the hydro-static pressure appropriate to the external depth of water below the mean level of the water in which the raft is to be founded.

The invention also provides a free standing maritime platform assembly for founding in water on a seabed including:

i. a foundation raft having underneath it an impermeable base surface;

ia. an opening in that surface remote from the edge thereof;

ii. a duct communicating via the opening with the pore water pressure beneath the base surface of the raft;

iia. a reservoir associated with the platform assembly connected to the duct for receiving pore water from beneath the base surface; and iii. a one way valve connected to and communicating with the reservoir responsive to the movement of waves and capable of permitting the egress of water therefrom when the trough of a wave passes over the raft, which one way valve is located at an elevation above said raft and below the lowest means water level envisaged, whereby pore water pressure at at least one point beneath the raft may be reduced with respect to the hydro-static pressure appropriate to the external depth of water below the mean level of water in which the raft is to be founded.

Preferably the one way valve is so designed that the internal water level in the reservoir will fall to approach the external trough level during wave action.

In one form of the invention it is preferred that the duct extends from the inside of the foundation raft upwardly to above the highest wave crest level envisaged, and the one-way valve is situated just below the lowest wave trough level envisaged, the cross-sectional area of the duct being substantial at least at and above valve level to provide the aforesaid reservoir above that level.

Water may then escape from the duct when the wave trough level is lower than that inside the shaft, and, because of the reservoir formed by the part of the duct above the valve, this level remains practically constant while a crest is passing.

Although it is conceivable for the duct to be carried up from the base of the foundation raft to a position beneath a submerged moored buoy or the like it is further preferred that the duct is rigidly attached to the assembly.

It is still further preferred that the duct runs up one leg of the structure.

In a variant form of the invention there is a free standing maritime platform assembly incorporating a foundation raft for founding in water on a sea bed, said raft having underneath it an impermeable base surface, and remote from the edge of that surface an opening, a reservoir within said raft, a shortened duct connected between said opening and said reservoir, said reservoir being gas pressurized, and venting means connected to and communicating with the reservoir, said venting means including a further duct leading from the pressurised reservoir and leading upwardly to at least adjacent the surface of the water and a one way valve means operably connected with said further duct responsive to the movement of waves and capable of permitting the egress of water from the reservoir if the trough of a wave passes over the raft which one way valve is located at an elevation above said raft and below the lowest mean water level envisaged, whereby pore water pressure at at least one point beneath the raft may be reduced with respect to the hydro-static pressure appropriate to the external depth of water below the mean level of water in which the raft is to be founded.

In this form it is preferred that a drainage layer on the base surface of the raft and the drainage layer communicates through the shortened duct to the aforesaid pressurised reservoir.

It is further preferred that the drainage layer comprises no fines concrete or the like.

Preferably the venting means is a spring-loaded non return valve which opens when a wave trough passes over the raft.

More specifically the invention provides a free standing maritime platform assembly including a foundation raft having a generally horizontal drainage layer of no-fines concrete communicating with the sea bed beneath the raft, an impermeable base surface above that layer, an opening in that surface remote from the edge thereof, a reservoir associated with said raft, a short duct joining the opening to the reservoir, and a further duct leading out of the reservoir and extending upwardly toward the platform, in which there is valve means connected to and communicating with the further duct, and arranged to allow water to flow out of the reservoir through the further duct when the pressure at the valve means is reduced due to the passage of the trough of a wave over the raft, said valve means being located at an elevation above said raft and below the lowest water level envisaged.

A specific embodiment of the invention and some varients thereof will now be described with reference to the accompanying drawings, in which.

Figure 1:
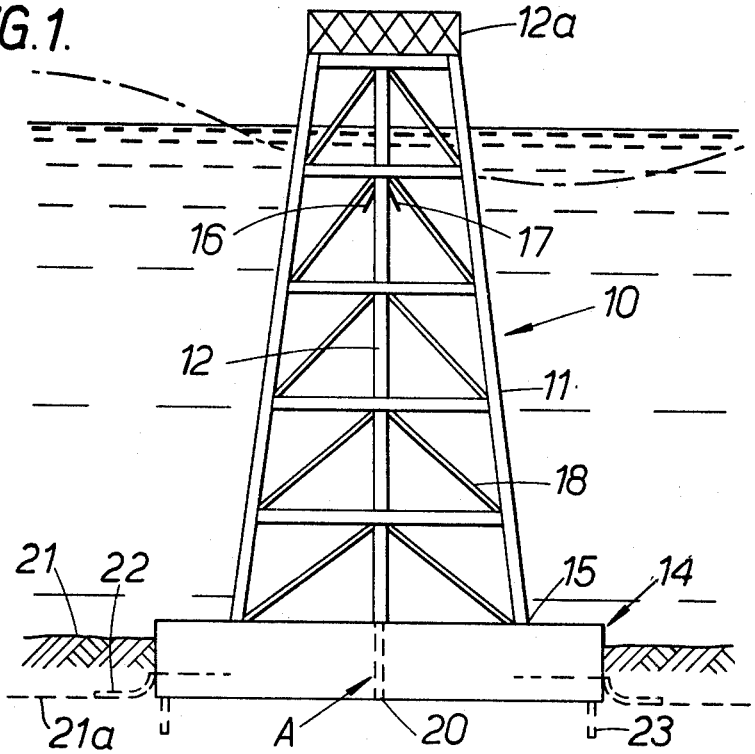
FIG. 1 is a central view on a maritime assembly having nine legs.

As shown in FIG. 1 a maritime assembly 10 has eight external legs 11 and a central leg 12. On top of the legs there is a deck or superstructure 12*a*, and at the feet of the legs there is a foundation raft 14. The legs of the steel tower structure are connected to the concrete foundation raft by means of joints 15. The distance between the sea bed and the mean sea level may be typically 150 meters, and to enable the pressure beneath the raft to respond to the differential pressures created by the passage of waves passing underneath the deck 12*a* the central leg 12 is hollow, and has a water duct passing up therethrough.

The water duct is open to the undersea strata via an opening 20 beneath the foundation raft, and is connected to flap valves 16 and 17 mounted on the central column 12 just beneath the lowest wave trough level. The valves 16 and 17 are so arranged that the water can escape from the central column whenever a trough of a wave passes the flaps. Typically the flap valves 16 and 17 are 15 meters below the surface of the sea. In this way the build up of pressure beneath the raft is reduced or avoided depending on the permeability of the under sea bed.

It is of course conceivable for the legs 11 to have ducts leading upwardly from the base of the raft.

As shown in FIG. 1 the legs are braced together by bracing members 18, and to give stability to the marine assembly as a whole it may be expedient for the legs 11 to be filled with concrete. In this instance the size of the duct running up the leg will be reduced, or it may not be possible to put a duct therethrough. In any case following the invention the leg 12 in the centre of the assembly should not be filled with concrete, and its full cross sectional area should be available for the sea water pressure equalisation duct. The opening 20 is conveniently the same opening that is used to remove spoil from below the raft during the founding thereof, if the foundation raft is sunk into the under sea bed as illustrated in FIG. 1 in which the sea bed is designated 21.

As an alternative to sinking the foundation raft into the undersea bed, a flexible apron 22, or relatively rigid skirt 23 may be provided to seal the underside of the raft off from the external water pressure and prevent the unimpeded passage of water around the lower edge of the periphery of the raft, and so to resist the pumping of loosened material away from underneath the raft. In these alternative embodiments the sea bed 21*a*, flexible apron 22 and rigid skirt 23 are shown in dotted lines.

FIG. 1 illustrates the principle of pore pressure venting, and shows just one under raft opening 20 connected to the flap valves 16 and 17.

Figure 2:
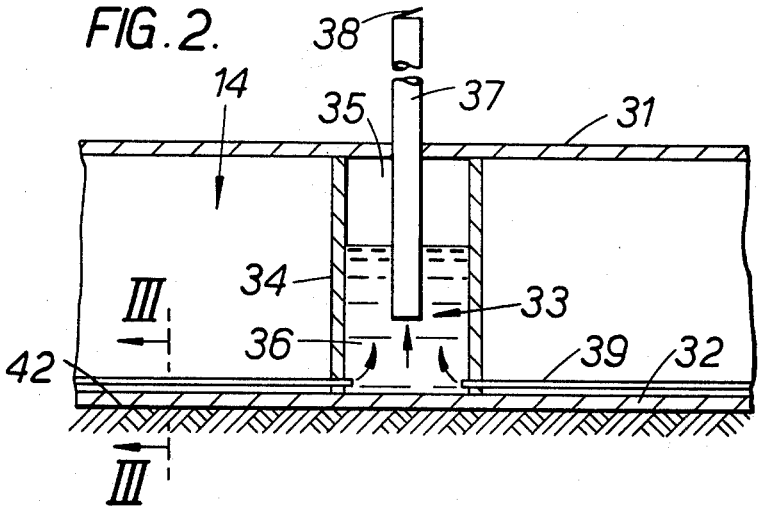
FIG. 2 shows a detailed cross section of a region marked by the arrow "A" in FIG. 1, illustrating a varient of the assembly shown in FIG. 1.
Figure 3:
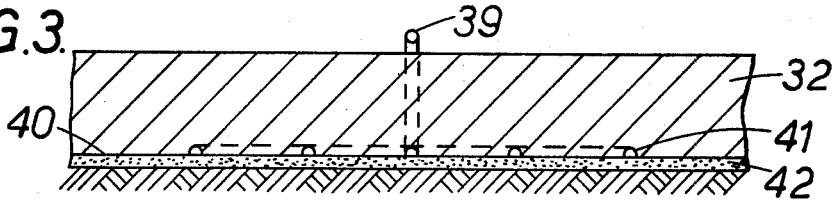
FIG. 3 is a magnified section on the line III — III in FIG. 2.

FIGS. 2 and 3 illustrate a varient arrangement to effect the venting of pore pressure build up. The raft 14 has upper and lower slabs 31 and 32 spaced by webs and walls, not shown. Beneath the leg 12 there is a reservoir 33 surrounded by walls 34, and the upper and lower slabs. The upper part 35 of the reservoir is used to contain a a pressurized air cushion (giving a local pressure within the reservoir equivalent to the lowest wave trough passing above it) and the lower part 36 is used as a manifold for the water ducts. A main water duct 37 leads upwardly through slab 31 to a flap valve 38 (which may be identical with the flap valves 16 and 17, or may be as shown,) just below the level of the deepest wave trough envisaged.

Drainage conduits 39 lead from the under surface 40 of the raft to the lower part 36 of the reservoir. The conduits 39 split up into a network of smaller drain conduits 41 which rest on a layer of 'no fines' concrete or other porous material, here designated 42. It is of course possible for the drainage conduits 39 and smaller drain conduits 41 to be applied to the embodiment of FIG. 1, in which no pressurized air cushion is needed; since the upper part of the duct 12 (ie above the valves 16 and 17) fulfills the same function as the upper part of the reservoir 33.

During wave action pressure on the air cushion in the drainage chamber (reservoir 33) will drop, and approach a pressure corresponding to the head of water beneath the wave trough. Water will drain out of the reservoir when the pressure therein exceeds the external pressure.

We claim:

1. A free standing maritime platform assembly incorporating a foundation raft for founding in water on a sea bed, said raft having underneath it an impermeable base surface, and remote from the edge of that surface an opening, a duct connected between that opening and a reservoir means associated with said platform assembly, and venting means connected to and communicating with the reservoir, said venting means including one way valve means responsive to the movement of waves and capable of permitting the egress of water from the reservoir if the trough of a wave passes over the raft, which one way valve is located at an elevation above said raft and below the lowest mean water level envisaged, whereby pore water pressure at at least one point beneath the raft may be reduced with respect to the hydro-static pressure appropriate to the external depth of water below the mean level of the water in which the raft is to be founded.

2. A free standing maritime platform assembly for founding in water on a seabed including:

i. a foundation raft having underneath it an impermeable base surface;

ia. an opening in that surface remote from the edge thereof;

ii. a duct communicating via the opening with the pore water pressure beneath the base surface of the raft;

iia. a reservoir associated with the platform assembly connected to the duct for receiving pore water from beneath the base surface; and iii. a one way valve connected to and communicating with the reservoir responsive to the movement of waves and capable of permitting the egress of water therefrom when the trough of a wave passes over the raft, which one way valve is located at an elevation above said raft and below the lowest mean water level envisaged, whereby pore water pressure at at least one point beneath the raft may be reduced with respect to the hydro-static pressure appropriate to the external depth of water below the mean level of water in which the raft is to be founded.

3. An assembly as claimed in claim 1 in which the duct extends from the inside of the foundation raft upwardly to above the highest wave crest level envisaged, and the one-way valve is situated just below the lowest wave trough level envisaged, the cross-sectional area of the duct being substantial at least at and above valve level to provide the aforesaid reservoir above that level.

4. An assembly as claimed in claim 3 in which the duct is rigidly attached to the structure.

5. An assembly as claimed in claim 3 in which the platform is supported on the foundation raft on legs, one of said legs is hollow, and the duct runs up the interior of the hollow leg of the structure.

6. An assembly as claimed in claim 2 in which the one way valve is so designed that the internal water level in the reservoir will fall to approach the external trough level during wave action.

7. A free standing maritime platform assembly incorporating a foundation raft for founding in water on a sea bed, said raft having underneath it an impermeable base surface, and remote from the edge of that surface an opening, a reservoir within said raft, a shortened duct connected between said opening and said reservoir, said reservoir being gas pressurized, and venting means connected to and communicating with the reservoir, said venting means including a further duct leading from the pressurized reservoir and leading upwardly to at least adjacent the surface of the water and a one way valve means operably connected with said further duct responsive to the movement of waves and capable of permitting the egress of water from the reservoir if the trough of a wave passes over the raft, which one way valve is located at an elevation above said raft and below the lowest mean water level envisaged, whereby pore water pressure at at least one point beneath the raft may be reduced with respect to the hydro-static pressure appropriate to the external depth of water below the mean level of water in which the raft is to be founded.

8. An assembly as claimed in claim 7 in which there is a drainage layer on the base surface of the raft, and the drainage layer communicates through the shortened duct to the aforesaid pressurized reservoir.

9. An assembly as claimed in claim 8 in which the drainage layer comprises no-fines concrete.

10. An assembly as claimed in claim 7 in which the venting means is a spring-loaded non-return valve which opens when a wave trough passes over the raft.

11. A free standing maritime platform assembly including a foundation raft having a generally horizontal drainage layer of no-fines concrete communicating with the sea bed beneath the raft, an impermeable base surface above that layer, an opening in that surface remote from the edge thereof, a reservoir associated with said raft, a short duct joining the opening to the reservoir, and a further duct leading out of the reservoir and extending upwardly toward the platform deck, in which there is valve means connected to and communicating with the further duct, and arranged to allow water to flow out of the reservoir through the further duct when the pressure at the valve means is reduced due to the passage of the trough of a wave over the raft, said valve means being located at an elevation above said raft and below the lowest water level envisaged.

* * * * *